US009556757B2

(12) United States Patent
Kajiura et al.

(10) Patent No.: US 9,556,757 B2
(45) Date of Patent: Jan. 31, 2017

(54) VALVE TIMING CONTROL APPARATUS FOR INTERNAL COMBUSTION ENGINE

(71) Applicant: HITACHI AUTOMOTIVE SYSTEMS, LTD., Hitachinaka-shi, Ibaraki (JP)

(72) Inventors: Mikihiro Kajiura, Tama (JP); Yosuke Iwase, Yokohama (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 119 days.

(21) Appl. No.: 14/658,786

(22) Filed: Mar. 16, 2015

(65) Prior Publication Data

US 2016/0076410 A1 Mar. 17, 2016

(30) Foreign Application Priority Data

Sep. 17, 2014 (JP) ..... 2014-188352

(51) Int. Cl.

| | |
|---|---|
| ***F01L 1/34*** | (2006.01) |
| ***F01L 1/344*** | (2006.01) |
| ***F01L 1/047*** | (2006.01) |
| ***F01L 1/46*** | (2006.01) |

(52) U.S. Cl.

CPC ..... *F01L 1/344* (2013.01); *F01L 1/047* (2013.01); *F01L 1/46* (2013.01)

(58) Field of Classification Search

CPC ..... F01L 1/344; F01L 1/047; F01L 1/46
USPC ..... 123/90.17
See application file for complete search history.

(56) References Cited

U.S. PATENT DOCUMENTS 8,006,658 B2 8/2011 Nakamura et al.
8,245,678 B2 * 8/2012 Watanabe ..... F01L 1/344 123/90.15

FOREIGN PATENT DOCUMENTS

JP 2013-036401 A 2/2013

OTHER PUBLICATIONS

Kajiura: US Office Action on U.S. Appl. No. 14/658,816 dated Apr. 8, 2016.
U.S. Appl. No. 14/658,816, filed Mar. 16, 2015, Hitachi Automotive Systems, LTD.
Kajiura: Notice of Allowance for U.S. Appl. No. 14/658,816 mailed Sep. 6, 2016.

* cited by examiner

*Primary Examiner* — Zelalem Eshete
(74) *Attorney, Agent, or Firm* — Foley & Lardner LLP

(57) ABSTRACT

A valve timing control apparatus for an internal combustion engine includes: a power feeding brush including a tip end portion arranged to be slidably abutted on the slip ring; and a rotation angle sensing mechanism provided between one end portion of the motor output shaft, and the cover member confronting the one end portion of the motor output shaft, and arranged to sense a rotation angle of the motor output shaft, the power feeding brush being disposed in a range in which the power feeding brush is slid on the slip ring, in a range from a position which is deviated a predetermined angle in a rotation direction of the motor housing from an uppermost position of the other of the electric motor and the cover member in a vertical direction, to a lowermost position.

9 Claims, 11 Drawing Sheets

VALVE TIMING CONTROL APPARATUS FOR INTERNAL COMBUSTION ENGINE

BACKGROUND OF THE INVENTION

This invention relates to a valve timing control apparatus for an internal combustion engine which are configured to control an opening timing and a closing timing of, for example, an intake valve and an exhaust valve.

Japanese Patent Application Publication No. 2013-0136401 discloses a valve timing control apparatus for an internal combustion engine including a cover member which is provided on an front end side of a motor housing of an electric motor with a predetermined clearance to confront the front end side of the motor housing. A power feeding plate is fixed at a front end portion of the motor housing. A pair of inner and outer annular slip rings are fixed to the power feeding plate. The slip rings confront the clearance. Moreover, a pair of power feeding brushes are provided on a confronting inner surface of the cover member. The power feeding brushes are arranged to be slidably abutted on the slip rings, and thereby to feed the power to a coil of the electric motor.

A rotation sensing mechanism is provided between one end portion of a motor output shaft of the electric motor which is on the cover member's side, and the cover member confronting the one end portion of the motor output shaft of the electric motor in the axial direction. The rotation sensing mechanism is arranged to sense a rotation angle of the motor output shaft.

This rotation sensing mechanism includes a sensed portion fixed to one end portion of the motor output shaft; and a sensing portion provided to confront a tip end portion of the sensed portion of the cover member. This sensing portion confronts the tip end portion of the sensed portion with a predetermined gap.

SUMMARY OF THE INVENTION

However, in the above-described valve timing control apparatus, the power feeding brush is provided at the uppermost position of the cover member in the vertical direction, that is, the uppermost position of the rotation angle sensing mechanism in the vertical direction.

Therefore, the metal abrasion powder of the power feeding brush which is generated at the sliding movement between the tip end portion of the power feeding brush and the surface of the slip ring is scattered in the rotational direction by the centrifugal force according to the rotation of the motor housing, so that the metal abrasion is adhered to the sensing portion and the sensed portion of the rotation angle sensing mechanism, and enters the clearance between the sensing portion and the sensed portion of the rotation angle sensing mechanism.

Accordingly, the detection accuracy of the rotation angle sensing mechanism may be deteriorated due to the influence of the metal abrasion powder.

It is, therefore, an object of the present invention to provide a valve timing control apparatus for an internal combustion engine which is devised to solve the above-mentioned problem, and to effectively suppress the adhesion of the metal abrasion powder which is scattered by the centrifugal force of the rotation of the motor housing to the rotation angle sensing mechanism, and the metal abrasion powder entering the clearance.

According to one aspect of the present invention, a valve timing control apparatus for an internal combustion engine comprises: a first member to which a rotational force is transmitted from a crank shaft; a second member which is arranged to be rotated relative to the first member, and to rotate as a unit with a cam shaft; an electric motor which includes a motor housing that is provided to the first member to rotate as a unit with the first member, and a motor output shaft, and which is arranged to rotate the second member relative to the first member by the motor output shaft; a cover member which is disposed on an outer end surface of the electric motor to confront the outer end surface of the electric motor in an axial direction; a slip ring which has an annular shape, which is provided to one of the electric motor and the cover member, and which is provided coaxially with the motor output shaft; a power feeding brush which is provided to the other of the electric motor and the cover member, and which includes a tip end portion arranged to be slidably abutted on the slip ring; and a rotation angle sensing mechanism which is provided between one end portion of the motor output shaft, and the cover member confronting the one end portion of the motor output shaft, and which is arranged to sense a rotation angle of the motor output shaft, the power feeding brush being disposed in a range in which the power feeding brush is slid on the slip ring, in a range from a position which is deviated a predetermined angle in a rotation direction of the motor housing from an uppermost position of the other of the electric motor and the cover member in a vertical direction, to a lowermost position.

According to another aspect of the invention, a valve timing control apparatus for an internal combustion engine comprises: a driving rotation member which is arranged to be rotated by a rotational force from a crank shaft; a driven rotation member which is arranged to be rotated relative to the driving rotation member, and to rotate synchronously with a cam shaft; an electric motor which includes a motor housing that is provided to the driving rotation member to rotate as a unit with the driving rotation member, and a motor output shaft, and which is arranged to rotate the driven rotation member relative to the driving rotation member; a cover member disposed to confront and cover a front end portion of the electric motor; a slip ring which is provided to the electric motor, which has an annular shape, and which is disposed coaxially with the motor output shaft; a power feeding brush which is provided to the cover member, and which includes a tip end portion slidably abutted on the slip ring; and a rotation angle sensing mechanism which is provided between one end portion of the motor output shaft, and the cover member confronting the one end portion of the motor output shaft, and which is arranged to sense a rotation angle of the motor output shaft, the power feeding brush being provided in a range from a predetermined angle position in the rotation direction of the motor housing from an uppermost position of the cover member in a vertical direction, to a lowermost position in the rotation direction of the motor housing.

BRIEF DESCRIPTION OF THE DRAWINGS

FIG. 8A is a front view. FIG. 8B is a left side view. FIG. 8C is a right side view.

FIG. 9A is a front view. FIG. 9B is a right side view. FIG. 9C is a back view.

DETAILED DESCRIPTION OF THE INVENTION

Hereinafter, a valve timing control apparatus for an internal combustion engine according to embodiments of the present invention are illustrated. Besides, in this embodiment, the present invention is applied to the intake valve side.

First Embodiment

Figure 1:
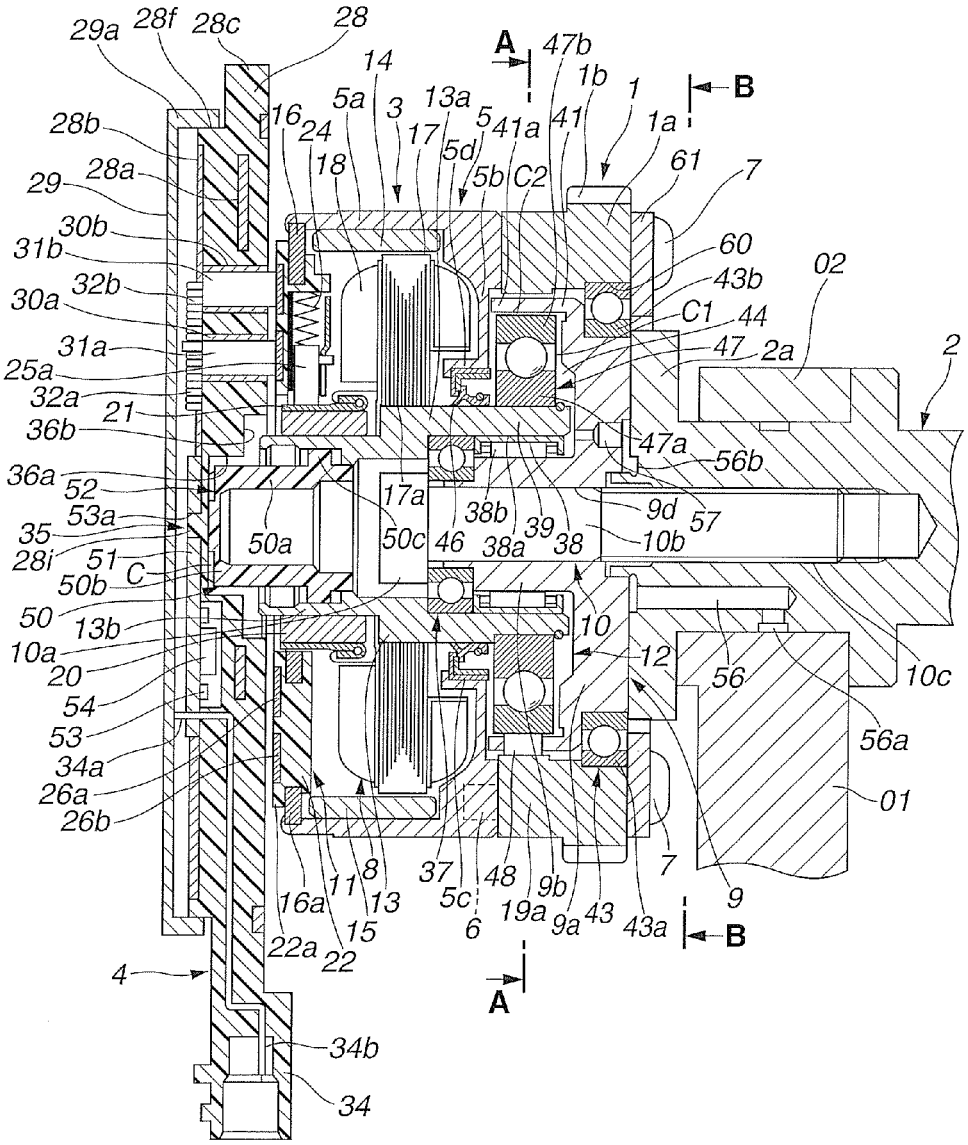
FIG. 1 is a sectional view showing a valve timing control apparatus according to a first embodiment of the present invention, which is taken along a section line C-C of FIG. 6.
Figure 2:
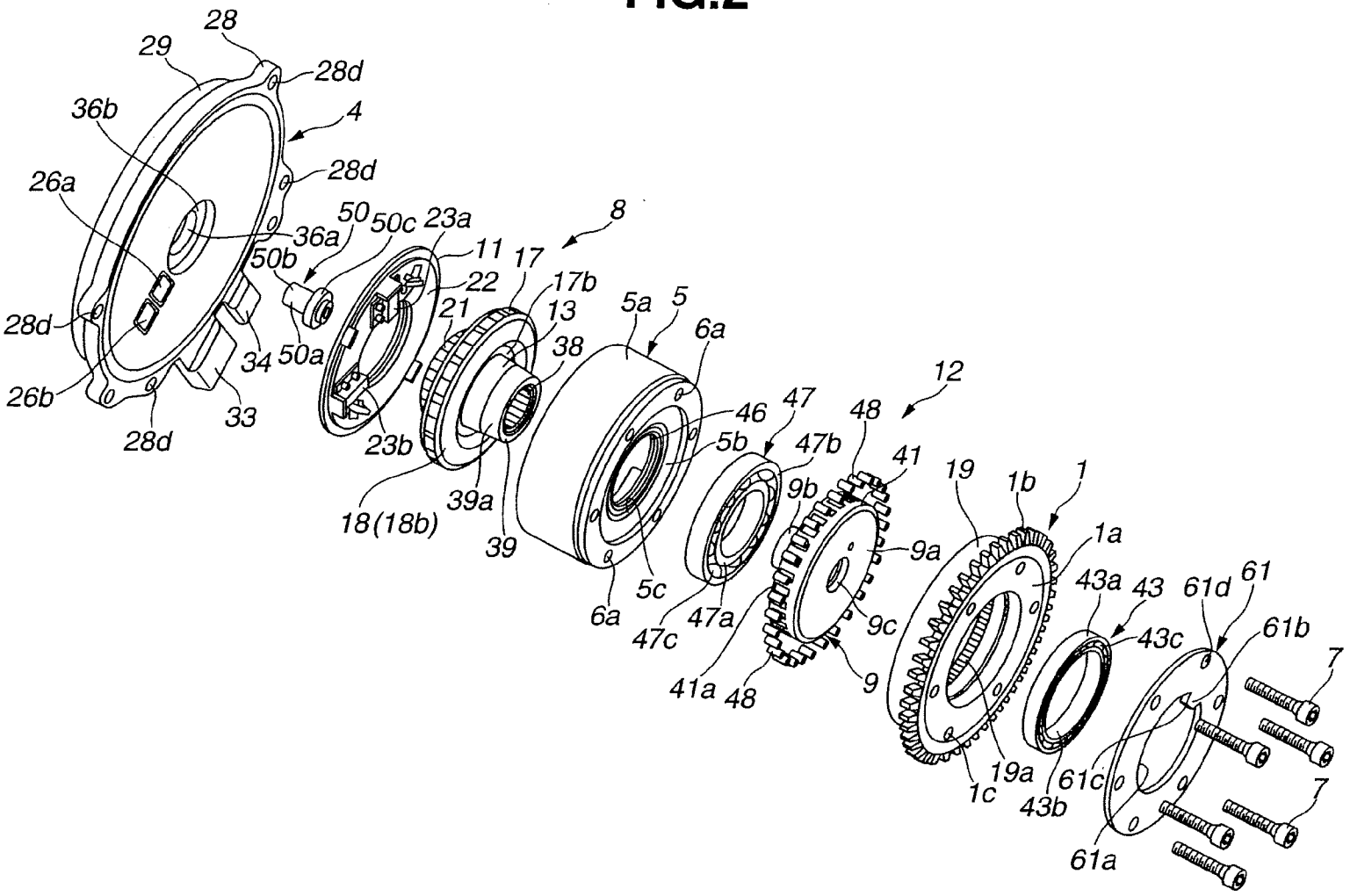
FIG. 2 is an exploded perspective view showing main components in the valve timing control apparatus according to the first embodiment.

As shown in FIG. 1 and FIG. 2, this valve timing control apparatus includes a timing sprocket 1 which is a first member (driving rotation member) which is drivingly rotated by a crank shaft of the internal combustion engine; a cam shaft 2 which is rotatably supported through a bearing 02 on a cylinder head 01, and which is rotated by a rotational force transmitted from the timing sprocket 1; a phase varying mechanism 3 which is disposed between the timing sprocket 1 and the cam shaft 2, and which is arranged to vary a relative rotational phase between the timing sprocket 1 and the cam shaft 2 in accordance with a driving state of the engine; and a cover member 4 disposed on a front end side of the phase varying mechanism 3.

An entire of the timing sprocket 1 is integrally made from iron series metal into an annular shape. The timing sprocket 1 includes a sprocket main body 1*a* which includes an inner circumference surface having a stepped shape; a gear portion 1*b* which is integrally provided on an outer circumference of the sprocket main body 1*a*, and which is arranged to receive the rotational force from the crank shaft through a wound timing chain (not shown); and an internal teeth constituting section 19 which is integrally provided on the front end side of the sprocket main body 1*a*.

Moreover, in this timing sprocket 1, a large diameter ball bearing 43 is disposed between the sprocket main body 1*a* and a driven member 9 (second member) (described later) provided at the front end portion of the cam shaft 2. The timing sprocket 1 and the cam shaft 2 are supported by this large diameter ball bearing 43 to be rotated relative to each other.

This large diameter ball bearing 43 is a general ball bearing. The large diameter ball bearing 43 includes an outer wheel 43*a*; an inner wheel 43*b*; and balls disposed between the outer wheel 43*a* and the inner wheel 43*b*. The outer wheel 43*a* is fixed on an inner circumference side of the sprocket main body 1*a*. The inner wheel 43*b* is fixed on the outer circumference side of the driven member 9 by the press-fit.

The sprocket main body 1*a* includes an outer wheel fixing portion 60 which is formed into an annular groove shape by cutting, which is formed on the inner circumference side of the sprocket main body 1*a*, and which is opened to the cam shaft 2's side (a right side in FIG. 1).

This outer wheel fixing portion 60 is formed into a stepped shape. The outer wheel 43*a* of the large diameter ball bearing 43 is press-fit in the outer wheel fixing portion 60 from an axial direction, so as to position an axial one side of this outer wheel 43*a*.

The internal teeth constituting section 19 is integrally provided on the outer circumference side of the front end portion of the sprocket main body 1*a*. The internal teeth constituting section 19 is formed into a cylindrical shape extending in a forward direction toward the phase varying mechanism 3. The internal teeth constituting section 19 includes a plurality of internal teeth 19*a* which have a waveform shape.

Figure 4:
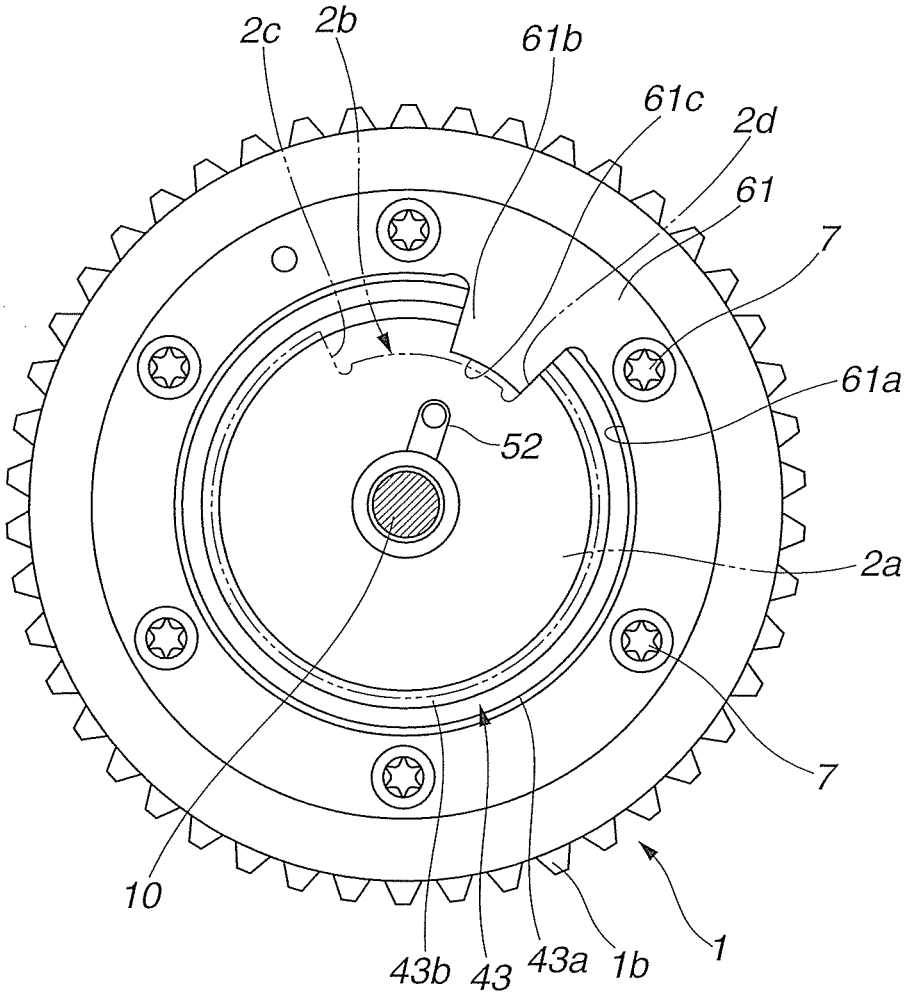
FIG. 4 is a sectional view taken along a section line B-B of FIG. 1.

Moreover, there is provided an annular holding plate 61 which is disposed on a rear end portion of the sprocket main body 1*a* that is opposite to the internal teeth constituting section 19. This holding plate 61 is integrally made from the metal plate. As shown in FIGS. 1 and 4, the holding plate 61 includes an outside diameter which is substantially identical to an outside diameter of the sprocket main body 1*a*, and an inside diameter which is smaller than an outside diameter of the outer wheel 43*a* of the large diameter ball bearing 43.

The holding plate 61 includes an inner circumference portion 61*a* which is disposed and abutted on an axial outer end surface of the outer wheel 43*a* of the large diameter ball bearing 43. Moreover, the holding plate 61 includes a stopper raised portion 61*b* which is integrally provided at a predetermined position of an inner circumference edge of the inner circumference portion 61*a*, and which protrudes in the radially inside direction, that is, toward the center axis.

This stopper raised portion 61*b* is formed into a substantially sectorial shape. The stopper raised portion 61*b* includes a tip end edge (radially inner end) 61*c* which is formed into an arc shape extending along an arc inner circumference surface of a stopper groove 2*b* (described later). Moreover, the holding plate 61 includes six bolt insertion holes 61*d* which are formed in an outer circumference portion of the holding plate 61, which are provided at a regular interval in the circumferential direction, which penetrate through the holding plate 61, and each of which a bolt 7 is inserted.

The sprocket main body 1*a* (the internal teeth constituting section 19) includes six bolt insertion holes 1*c* which are formed in the outer circumference portion of the sprocket main body 1*a* at a substantially regular interval in the circumferential direction, and which penetrate through the sprocket main body 1*a*. The holding plate 61 includes the six bolt insertion holes 61*d* which are formed in the outer circumference portion of the holding plate 61 at the substantially regular interval in the circumferential direction, and which penetrate through the holding plate 61. Besides, the sprocket main body 1*a* and the internal teeth constituting section 19 constituting a casing of a speed reduction mechanism 12 (described later).

The sprocket main body 1*a*, the internal teeth constituting section 19, the holding plate 61, and a housing main body 5*a* (described later) have a substantially identical outside diameter.

The cam shaft 2 includes two drive cams which are provided to one of the cylinders, and which are provided on an outer circumference of the cam shaft 2, and each of which is arranged to open the intake valve (not shown); and the flange portion 2*a* integrally provided at the front end portion of the cam shaft 2.

As shown in FIG. 1, this flange portion 2*a* has an outside diameter which is slightly larger than an outside diameter of a fixing end portion 9*a* of the driven member 9, so that the outer circumference portion of the front end surface of the flange portion 2*a* is disposed and abutted on the axial outer end surface of the inner wheel 43*b* of the large diameter ball bearing 43 after the constituting components are assembled. Moreover, the flange portion 2*a* (the cam shaft 2) is connected to the driven member 9 by a cam bolt 10 in a state where the front end surface of the flange portion 2*a* is abutted on the driven member 9 in the axial direction.

Furthermore, as shown in FIG. 4, the flange portion 2*a* includes the stopper recessed groove 2*b* which is formed on the outer circumference of the flange portion 2*a* along the circumferential direction, and into which the stopper raised portion 61*b* of the holding plate 61 is engageably inserted. This stopper recessed groove 2*b* is formed into an arc shape having a predetermined circumferential length. The stopper raised portion 61*b* is arranged to be pivoted in a range of this circumferential length of the stopper recessed groove 2*b*. Both end circumferential edges of the stopper raised portion 61*b* are arranged to be abutted, respectively, on confronting circumferential edges 2*c* and 2*d* of the stopper recessed groove 2*b*, so as to restrict the relative rotational position of the cam shaft 2 on the maximum advance angle side or the maximum retard angle side with respect to the timing sprocket 1.

The stopper raised portion 61*b* is disposed at a position which is apart toward the cam shaft 2's side, relative to a portion of the holding plate 61 that is fixed to confront the outer wheel 43*a* of the large diameter ball bearing 43 from the axially outward direction (at a position on the cam shaft 2's side of a portion of the holding plate 61 that is fixed to confront the outer wheel 43*a* of the large diameter ball bearing 43 from the axially outward direction). The stopper raised portion 61*b* is not contacted on the fixing end portion 9*a* of the driven member 9 in the axial direction. Accordingly, it is possible to suppress the interference between the stopper raised portion 61*b* and the fixing end portion 9*a*.

As shown in FIG. 1, the cam bolt 10 includes a head portion 10*a* having an axial end surface which supports an inner wheel of a small ball bearing 37 from the axial direction; and a shaft portion 10*b* having an outer circumference which includes an external screw that is screwed in the internal screw formed inside the cam shaft 2 from the end portion of the cam shaft 2 in the axial direction.

The driven member 9 is integrally made from the iron series metal. As shown in FIG. 1, the driven member 9 includes the fixing end portion 9*a* which has a circular plate shape, and which is formed on a rear end side (the cam shaft 2's side); a cylindrical portion 9*b* which protrudes from the front end surface of the inner circumference of the fixing end portion 9*a* in the axial direction; and a holding (retaining) device 41 which has a cylindrical shape, which is integrally formed on the outer circumference portion of the fixing end portion 9*a*, and which holds a plurality of rollers 48.

The fixing end portion 9*a* includes a rear end surface which is disposed and abutted on the front end surface of the flange portion 2*a* of the cam shaft 2. The fixing end portion 9*a* is fixed to the flange portion 2*a* by the pressure welding by the axial force of the cam bolt 10 in the axial direction.

As shown in FIG. 1, the cylindrical portion 9*b* includes an insertion hole 9*d* which is formed at a substantially central portion of the cylindrical portion 9*b*, which penetrates through the cylindrical portion 9*b*, and through which the shaft portion 10*b* of the cam bolt 10 is inserted. A needle bearing 38 is provided on the outer circumference side of the cylindrical portion 9*b*.

As shown in FIG. 1, the holding device 41 has a section having a substantially L-shape by bending from the front end of the outer circumference portion of the fixing end portion 9*a* in the forward direction. The holding device 41 has a bottomed cylindrical shape protruding in a direction identical to that of the cylindrical portion 9*b*.

Figure 3:
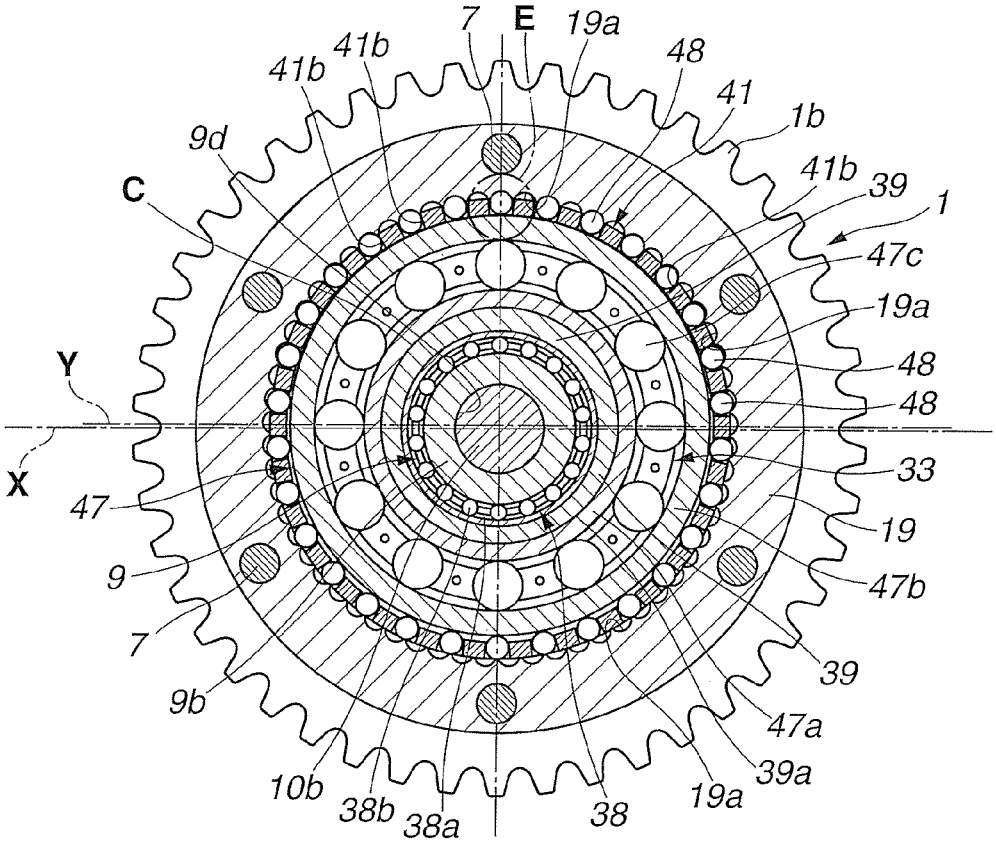
FIG. 3 is a sectional view taken along a section line A-A of FIG. 1.

The cylindrical tip end portion 41*a* of the holding device 41 extends toward the separation wall 5*b* of the motor housing 5 through a receiving space 44 which has an annular recessed shape, and which is separated by the internal teeth constituting section 19, the separation wall 5*b* and so on. Moreover, as shown in FIGS. 1-3, the cylindrical tip end portion 41*a* of the holding device 41 includes a plurality of roller holding holes 41*b* each of which has a substantially rectangular shape, which are formed at a regular interval in the circumferential direction, and each of which is arranged to hold one of the plurality of the rollers 48 so that the rollers 48 are rolled. Each of the roller holding holes 41*b* (the rollers 48) has a shape which is elongated in the forward and rearward directions, and which has a tip end portion side that is closed. A number of the roller holding holes 41*b* (the rollers 48) is smaller than a number of the teeth of the internal teeth 19*a* of the internal teeth constituting section 19. With this, it is possible to obtain a speed reduction ratio.

The phase varying mechanism 3 includes the electric motor 8 disposed on the front end side of the cylindrical portion 9*b* of the driven member 9; and a speed reduction mechanism 12 arranged to reduce a rotation speed of the electric motor 8, and to transmit the reduced rotation speed to the cam shaft 2.

As shown in FIG. 1 and FIG. 2, the electric motor 8 is a DC motor with a brush. The electric motor 8 includes the motor housing 5 which is a yoke arranged to rotate as a unit with the timing sprocket 1; a motor output shaft 13 which is rotatably received within the motor housing 5; four permanent magnets 14 and 15 each of which has a semi-arc shape, and which is a stator fixed on an inner circumference surface of the motor housing 5.

As shown in FIG. 1, the motor housing 5 includes the housing main body 5*a* which is formed into a bottomed cylindrical shape by press-forming the iron series metal material; and a power feeding plate 11 which closes a front end opening of the housing main body 5*a*.

The housing main body 5*a* includes a separation wall 5*b* which has a circular plate shape, and which is disposed on a rear end side of the housing main body 5*a*; a shaft insertion hole 5*c* which has a large diameter, which is formed at a substantially central portion of the separation wall 5*b*, and through which an eccentric shaft portion 39 (described later) is inserted; and an elongating portion 5*d* which has a cylindrical shape, which is integrally provided on an edge of the shaft insertion hole 5*c*, and which protrudes in the axial direction of the cam shaft 2. The separation wall 5*b* includes internal screw holes 6*a* which are formed in the axial direction in the inside of the separation wall 5*b* on the outer circumference side. Besides, the internal teeth constituting section 19 is abutted on a rear end surface of the separation wall 5*b* of the housing main body 5*a* from the axial direction.

Moreover, the internal screw holes 6*a* are formed at positions corresponding to the positions of the bolt insertion holes 1*c* and 61*d*. The timing sprocket 1, the holding plate 61, and the motor housing 5 are fixed by being tightened together by the six bolts 7 inserted through the bolt insertion holes 1*c* and 61*d*, and the internal screw holes 6*a* from the axial direction.

The motor output shaft 13 serves as an armature. The motor output shaft 13 is formed into a stepped cylindrical shape. The motor output shaft 13 includes a stepped portion which is formed at a substantially central portion of the motor output shaft 13 in the axial direction; a large diameter portion 13*a* which is positioned on the cam shaft 2's side of the stepped portion; and a small diameter portion 13*b* on a side of the stepped portion which is opposite to the large diameter portion 13*a*. An iron core rotor 17 is fixed on an outer circumference of the large diameter portion 13*a*. The eccentric shaft portion 39 constituting a part of the speed reduction mechanism 12 is integrally formed at the rear end portion of the large diameter portion 13*a*.

On the other hand, an annular member 20 is fixed on an outer circumference of the small diameter portion 13*b* by the press-fit. A commutator 21 (described later) is fixed on an outer circumference surface of the annular member 20 by the press-fit from the axial direction. The annular member 20 has an outside diameter which is substantially identical to the outside diameter of the large diameter portion 13*a*. The annular member 20 is disposed at a substantially central position of the small diameter portion 13*b* in the axial direction.

The iron core rotor 17 is made from a magnetic material having a plurality of magnetic poles. The iron core rotor 17 includes an outer circumference portion which is a bobbin that has slots on which coil wire of coil 18 is wound; and an inner circumference portion. The inner circumference portion of the iron core 17 is positioned and fixed on the outer circumference of the stepped portion of the motor output shaft 13 in the axial direction.

On the other hand, the commutator 21 is made from conductive material into an annular shape. The commutator 21 includes segments which are obtained by dividing the commutator 21 by the number which is identical to the number of the poles of the iron core rotor 17, and to which terminals of the pulled-out coil wire of the coil 18 are electrically connected.

Each of the permanent magnets 14 and 15 has an overall cylindrical shape. Each of the permanent magnets 14 and 15 has the plurality of the magnetic poles in the circumferential direction. The permanent magnets 14 and 15 are positioned at axial positions which are offset from the axial center (the center in the axial direction) of the iron core rotor 17 on the power feeding plate 11's side. With this, the front end portions of the permanent magnets 14 and 15 are disposed to be overlapped, in the radial direction, with switching brushes 25*a* and 25*b* (described later) which are provided to the commutator 21 and the power feeding plate 11.

Figure 5:
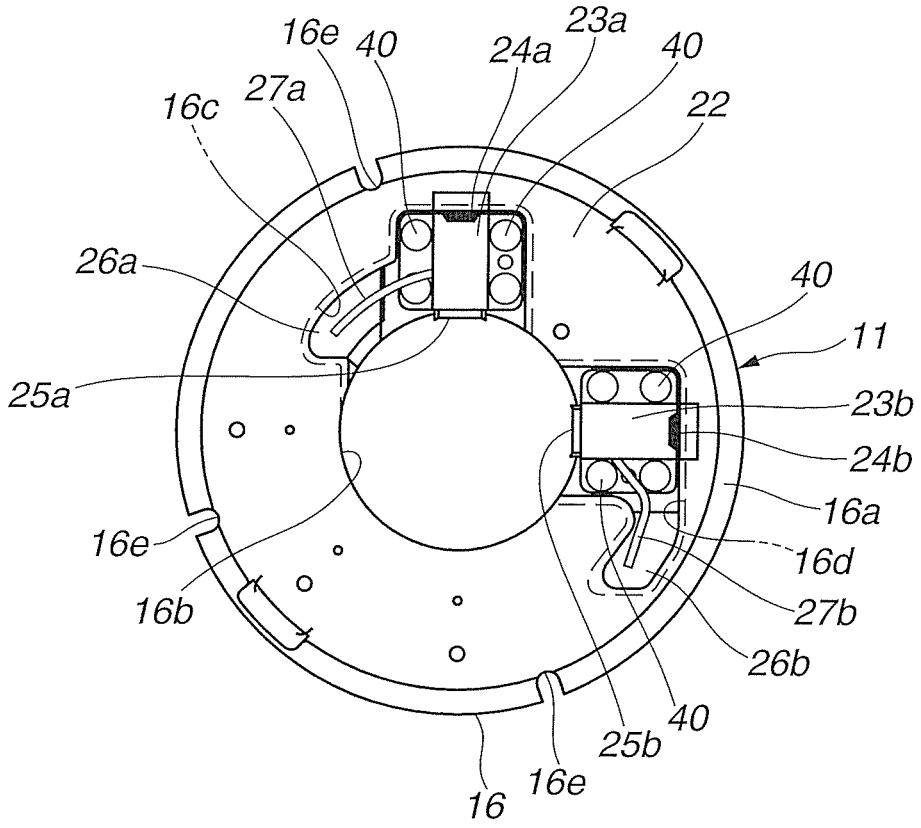
FIG. 5 is a back view showing a power feeding plate in the valve timing control apparatus according to the first embodiment.

As shown in FIG. 1 and FIG. 5, the power feeding plate 11 includes a rigid plate portion 16 which is made from metal series material, and which has a substantially disc shape; and a resin portion 22 which has a circular plate shape, and which is molded on front and rear side surfaces of the rigid plate portion 16. Besides, this power feeding plate 11 constitutes a part of the power feeding mechanism to the electric motor 8.

As shown in FIG. 1, the rigid plate 16 includes an outer circumference portion 16*a* which is not covered with the resin portion 22, and which is poisoned and fixed in an annular stepped recessed portion that is formed on the inner circumference of the front end portion of the motor housing 5 by caulking. Moreover, the rigid plate 16 includes a shaft insertion hole 16*b* which is formed at a central portion of the rigid plate 16, into which one end portion of the motor output shaft 13 and so on is inserted, and which penetrates through the rigid plate 16. Furthermore, as shown in FIG. 5, the rigid plate 16 includes two holding holes 16*c* and 16*d* which have different shapes, which are formed, by punching (stamping), on an inner circumference edge of the shaft insertion hole 16*b* at predetermined continuous positions. Brush holders 23*a* and 23*b* (described later) are mounted and held in these holding holes 16*c* and 16*d*.

Besides, the rigidity plate 16 includes three U-shaped grooves 16*e* which are formed on the outer circumference portion 16*a* at predetermined circumferential positions, and which are arranged to position the rigidity plate 16 in the circumferential direction with respect to the housing main body 5*a* through a jig (not shown).

Moreover, as shown in FIG. 1 and FIG. 5, the power feeding plate 11 is provided with a pair of the brush holders 23*a* and 23*b* which are made from a copper, which are disposed, respectively, within the holding holes 16*c* and 16*d* of the rigid plate 16, and which are fixed to the front end portion 22*a* of the resin portion 22 by a plurality of rivets 40; a pair of switching brushes 25*a* and 25*b* which are received within the brush holders 23*a* and 23*b*, which are arranged to be slid in the radial directions, each of which includes an arc tip end surface that is elastically abutted on the outer circumference surface of the commutator 21 from the radial direction by spring forces of coil springs 24*a* and 24*b*, and which are commutators; inner and outer power feeding slip rings 26*a* and 26*b* which are inside and outside annular conductive members which are molded and fixed on the front end portion 22*a*'s side of the resin portion 22 in a state where outer side surfaces of the inner and outer power feeding slip rings 26*a* and 26*b* are exposed; and harnesses 27*a* and 27*b* which electrically connect the switching brushes 25*a* and 25*b* and the slip rings 26*a* and 26*b*.

The slip ring 26*a* which has the small diameter, and which is positioned on the inner circumference side is formed into an annular shape by punching (stamping) a thin plate made from the copper by press. The slip ring 26*b* which has the large diameter, and which is positioned on the outer circumference side is formed into an annular shape by punching (stamping) a thin plate made from the copper by press.

Figure 6:
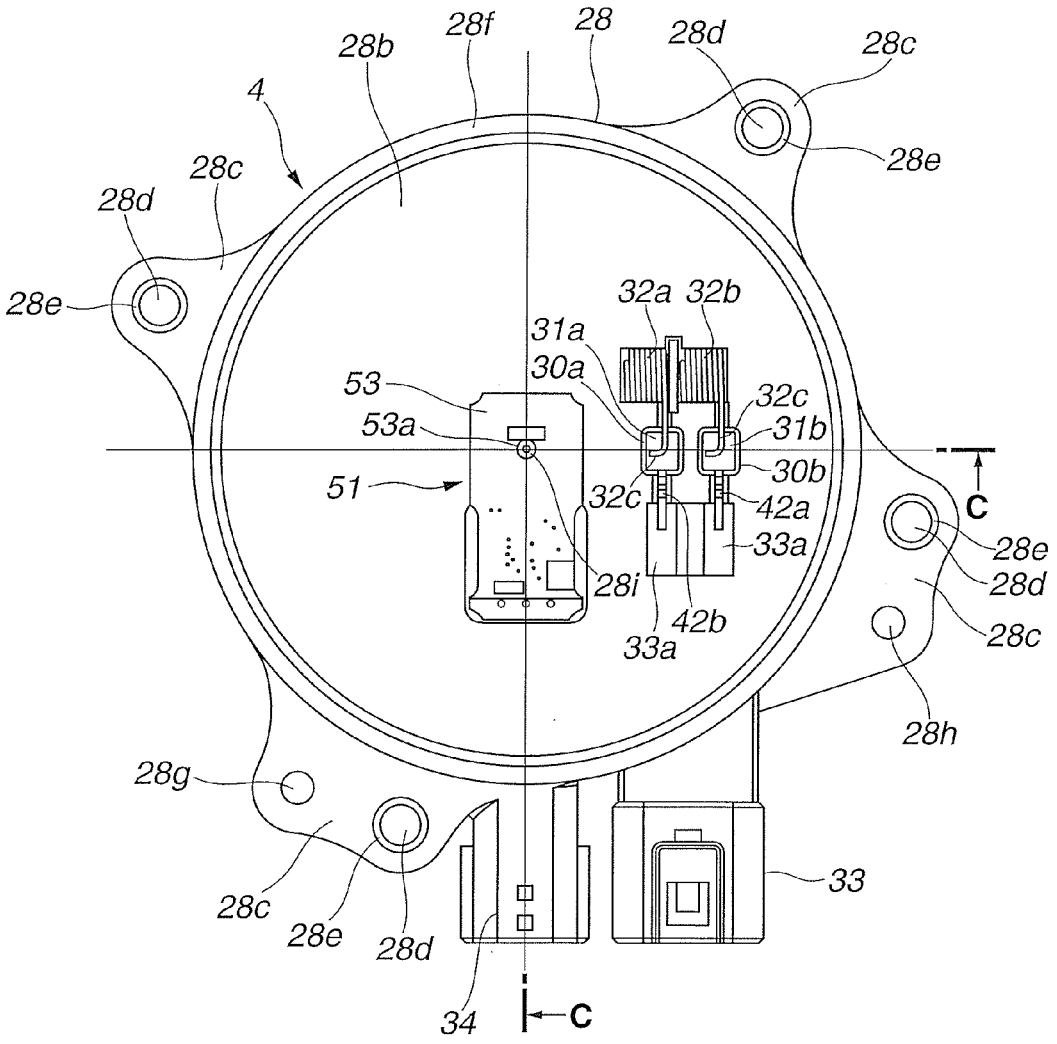
FIG. 6 is a back view showing a cover main body in a state where a cover portion is detached, in the valve timing control apparatus according to the first embodiment.
Figure 7:
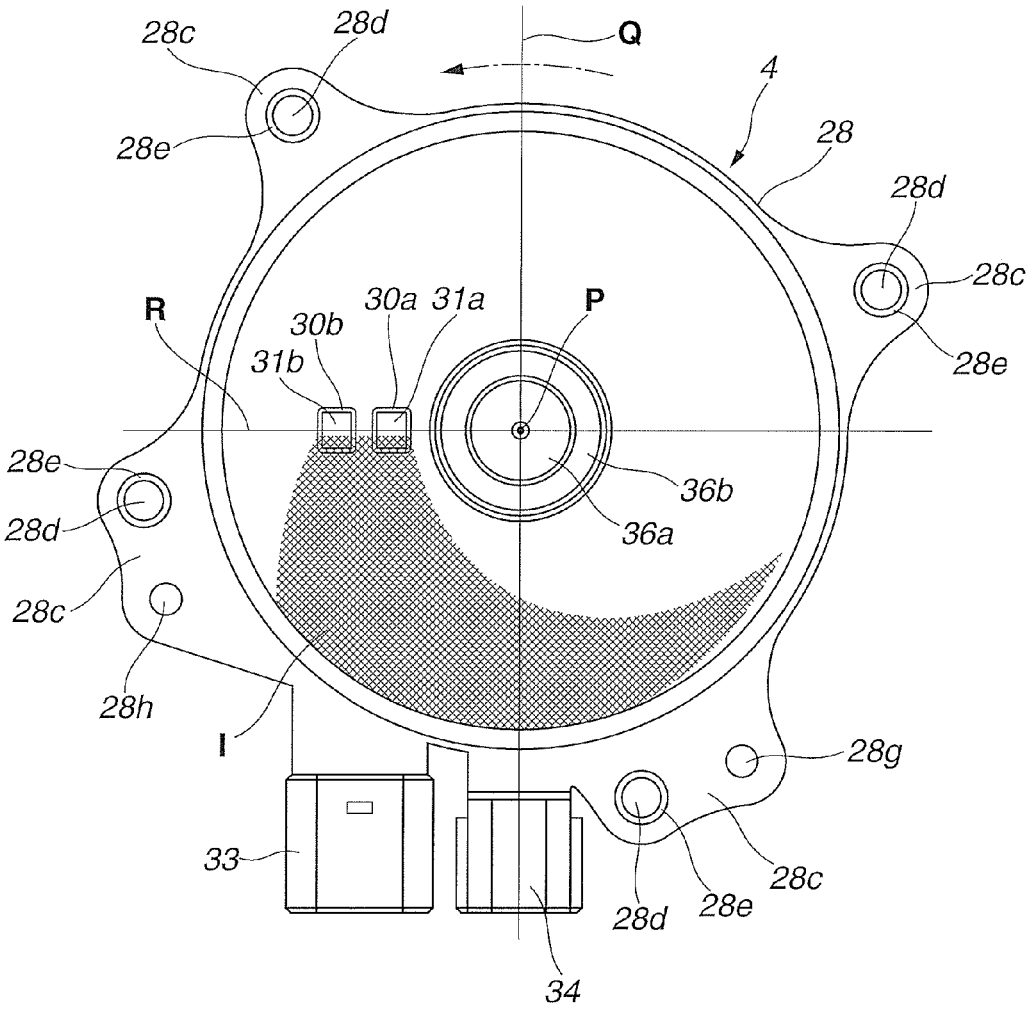
FIG. 7 is a front view showing the cover main body.

As shown in FIG. 1, FIG. 6 and FIG. 7, the cover member 4 is formed into a substantially disc shape. The cover member 4 is disposed on the front end side of the power feeding plate 11 to cover the front end opening of the housing main body 5*a*. The cover member 4 includes a cover main body 28 which is made mainly from synthetic resin material, and which has a circular plate shape; and a cover portion 29 which is made from synthetic resin material, and which covers the front end portion of the cover main body 28.

The cover main body 28 has a predetermined thickness. The cover main body 28 has an outside diameter which is larger than the outside diameter of the housing main body 5*a*. A reinforce plate 28*a* which is made from the metal, and which is a core member is mold and fixed inside the cover main body 28. The cover main body 28 includes four arc boss portions 28*c* which are provided on the outer circumference portion of the cover main body 28 to protrude; and bolt insertion holes 28*d* which are formed in the boss portions 28*c*, and into which bolts fixed to a chain cover (not shown) are inserted. The bolt insertion holes 28*d* are formed by metal sleeves 28*e* which are molded in the resin material.

The cover portion 29 is formed into a disc shape. The cover portion 29 includes a retaining raised portion 29*a* which has an annular shape, and which is integrally formed on the outer circumference edge of the cover portion 29. The retaining raised portion 29*a* of the cover portion 29 is retained and fixed to a stepped retaining groove 28*f* formed on the outer circumference portion of the cover main body 28, by the press-fit from the axial direction. Besides, two boss portions 28*c* and 28*c* includes, respectively, positioning holes 28*g* and 28*h* which have small diameters, which penetrates through the two boss portions 28*c* and 28*c*, and into which positioning pins (not shown) that protrudes from the chain case (not shown) or the cylinder head are inserted and engaged to position the cover main body 28 with respect to the chain case or the cylinder head in the radial direction and the rotation direction.

A pair of brush holders 30*a* and 30*b* each of which has a rectangular hollow shape are fixed to the cover main body 28 along the axial direction at positions at which the brush holders 30*a* and 30*b* confront the slip rings 26*a* and 26*b* from the axial direction. The power feeding brushes 31*a* and 31*b* are held within the brush holders 30*a* and 30*b* to be slid in the axial direction. The power feeding brushes 31*a* and 31*b* include tip end surfaces which are slidably abutted on the slip rings 26*a* and 26*b*.

As shown in the front view of FIG. 7 when viewed from the motor housing 5's side, the brush holders 30*a* and 30*b*, and the power feeding brushes 31*a* and 31*b* are disposed in parallel manner at substantially central position of the cover main body 28 in the radial direction. Moreover, the brush holders 30*a* and 30*b*, and the power feeding brushes 31*a* and 31*b* at a position rotated substantially 90 degrees in the rotation direction of the motor housing 5 which is shown by a chain line in FIG. 7 from a vertical line Q passing through a center axis P of the cover main body 28. That is, the brush holders 30*a* and 30*b*, and the power feeding brushes 31*a* and 31*b* are disposed on the horizontal line R on the forward side of the rotation direction of the motor housing 5 relative to the vertical line Q of the cover main body 28.

Moreover, this cover main body 28 includes a recessed groove 36*a* which is formed at a substantially central position of the inner surface of the cover main body 28 on the electric motor 8's side (the right side in FIG. 1), and which constitutes a part of a circular recessed portion in which a tip end portion 50*b* of a sensed portion 50 (described later) is inserted and mounted. This recessed groove 36*a* is recessed on the axially outer side of the cover main body 28. The recessed groove 36*a* has an inside diameter which is larger than the tip end portion 50*b*, and a depth which is slightly smaller than an axial width of the cover main body 28. In this way, the recessed groove 36*a* has a thin bottom wall. A positioning raised portion 28*i* is integrally provided at a substantially central position of an outer surface of the thin bottom wall.

Moreover, the cover main body 28 includes a large diameter groove 36*b* which is formed on the outer circumference of (radially outside) the opening portion of the recessed groove 36*a*, and which has an inside diameter larger than the inside diameter of the recessed groove 36*a*. As shown in FIG. 1 and FIG. 7, this large diameter groove 36*b* has an inside diameter which is substantially identical to the outside diameter of the annular member 20, and a depth which is a length from the rear end surface of the central portion of the cover main body 28 to a substantially axial central position of the cover main body 28 (the opening end of the recessed groove 36*a*). The large diameter groove 36*b* and the recessed groove 36*a* are offset in the outward direction from the abutment positions between the slip rings 26*a* and 26*b* and the tip end portions of the power feeding brushes 31*a* and 31*b*. The large diameter groove 36*b* and the recessed groove 36*a* constitute labyrinth groove.

A pair of twist coil springs 32*a* and 32*b* are provided on the cover portion 28*b*'s side of the cover main body. The twist coil springs 32*a* and 32*b* are arranged to urge the power feeding brushes 31*a* and 31*b* toward the slip rings 26*a* and 26*b*.

Each of the brush holders 30*a* and 30*b* includes opening portions which are formed at front and rear ends of the each of the brush holders 30*a* and 30*b*. A tip end portion of each of the power feeding brushes 31*a* and 31*b* is moved in the forward and rearward directions from the opening portion on the front end's side of the each of the brush holders 30*a* and 30*b*. One end portions of pigtail harnesses 42*a* and 42*b* are connected through slit holes formed on the side surfaces of the rear end portions to the rear ends of the power feeding brushes 31*a* and 31*b* by the soldering.

Each of the power feeding brushes 31*a* and 31*b* is formed into a rectangular solid cylindrical shape having a predetermined axial length. Each of the power feeding brushes 31*a* and 31*b* has a flat tip end surface arranged to be abutted on one of the slip rings 26*a* and 26*b* from the axial direction.

Each of the pigtail harnesses 42*a* and 42*b* has a length by which the power feeding brushes 31*a* and 31*b* are not dropped from the brush holders 30*a* and 30*b* even when the power feeding brushes 31*a* and 31*b* are pushed by the spring forces of the twist coil springs 32*a* and 32*b*.

A power source feeding connector 33 is integrally provided at a lower end portion of the cover main body 28. The power source feeding connector 33 is arranged to supply current from a control unit (not shown) to the power feeding brushes 31*a* and 31*b*. The signal connector 34 is provided at the lower end portion of the cover main body 28 to protrude in parallel to the power source feeding connector 33 along the radial direction. The signal connector 34 is arranged to output the rotation angle signal sensed by the sensing portion 51, to the control unit.

The power source feeding connector 33 includes first end portions 33*a* and 33*a* of terminal strips which are partially embedded in the cover main body 28, and which are connected to second end portions of the pigtail harnesses 42*a* and 42*b*; and second end portions (not shown) of the terminal strips which are exposed to the outside, and which are connected to female terminals (not shown) on the control unit's side.

On the other hand, as shown in FIG. 1, the signal connector 34 includes first end portions 34*a* of terminal strips which are partially embedded in the cover main body 28, and which are connected to an integrated circuit 54 of a print board 53; and second end portions 34*b* of the terminal strips which are exposed to the outside, and which are connected to the female terminal on the control unit's side.

An angle sensor 35 is provided between the small diameter portion 13*b* of the motor output shaft 13, and a central portion of the cover main body 28 to sandwich the bottom wall of the recessed groove 36*a*. The angle sensor 35 is a rotation angle sensing mechanism arranged to sense a rotation angle position of the motor output shaft 13.

This angle sensor 35 is non-contact type and electromagnetic induction type. The angle sensor 35 includes the sensed portion 50 which is fixed within the small diameter portion 13*b* of the motor output shaft 13; and the sensing portion 51 which is fixed at a substantially central position of the cover main body 28, and which is arranged to receive a detection signal from the sensed portion 50.

Figure 8A:
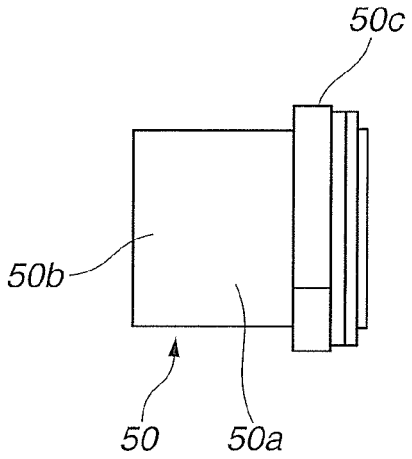
FIGS. 8A, 8B, and 8C are views showing a sensed portion in the valve timing control apparatus according to the first embodiment.
Figure 8B:
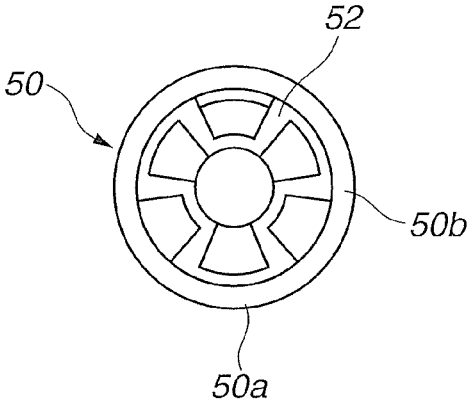
Figure 8C:
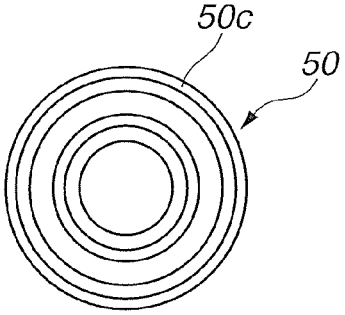
Figure 9A:
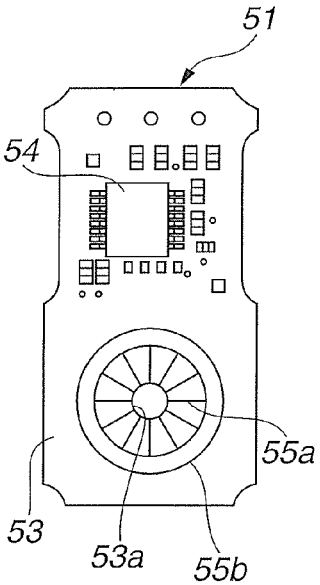
FIGS. 9A, 9B, and 9C are views showing a sensing portion in the valve timing control apparatus according to the first embodiment.
Figure 9B:
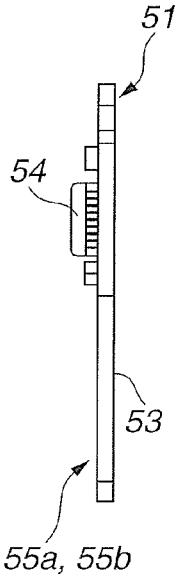
Figure 9C:
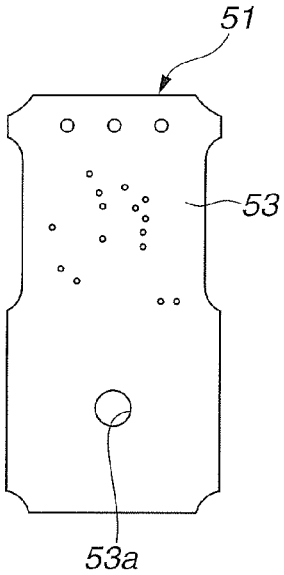

As shown in FIGS. 8A-8C, the sensed portion 50 includes a support portion 50*a* which is made from the synthetic resin material into a substantially bottomed cylindrical shape, and which includes an axial tip end portion 50*b*. A sensed rotor 52 which has a thin trilobed (three leaves) shape is fixed on a bottom wall surface of the axial tip end portion 50*b* of the support portion 50*a*. Furthermore, the sensed portion 50 includes an annular protrusion 50*c* which is integrally provided on the outer circumference of the rear end portion of the outer circumference of the support portion 50*a*, and which is press-fit in the inside of the small diameter portion 13*b* of the motor output shaft 13.

The support portion 50*a* has an outside diameter which is smaller than the inside diameter of the recessed groove 36*a*. The tip end portion 50*b* of the support portion 50*a* which protrudes from the tip end of the small diameter portion 13*b* of the motor output shaft 13 is inserted and disposed in the recessed groove 36*a* of the cover main body 28. The sensed rotor 52 is disposed to confront the bottom surface of the recessed groove 36*a*.

As shown in FIG. 1 and FIGS. 9A-9C, the sensing portion 51 includes a print board 53 which has a substantially rectangular shape extending from a substantially central position of the cover main body 28 in the radial direction; the integrated circuit (ASIC) 54 which is provided on an outer surface of a first end portion of the print board 53 in the longitudinal direction; and a receiving circuit 55*a* and an oscillating circuit 55*b* provided on a second end portion of the outer surface of the print board 53 which is the same surface as the integrated circuit 54.

The print board 53 includes a positioning small hole 53*a* formed at a central portion of the receiving circuit 55*a* and the oscillating circuit 55*b*. This positioning small hole 53*a* is fit on the positioning raised portion 28*i* by the press-fit to position the center of the sensed rotor 52 and the centers of the receiving circuit 55*a* and the oscillating circuit 55*b*.

Moreover, the print board 53 is joined and fixed on the front end surface of the cover main body 28 by a predetermined joining means such as screw. Accordingly, the receiving circuit 55*a* and the oscillating circuit 55*b* confront the sensed rotor 52 through a minute clearance C between the receiving circuit 55*a* and the oscillating circuit 55*b*, and the bottom wall of the recessed groove 36*a*.

Consequently, the induction current flows between the oscillating circuit 55 and the sensed rotor 52 by the rotation of the sensed rotor 52 according to the rotation of the motor output shaft 13 through the support portion 50*a*. The integrated circuit 54 is arranged to sense the rotation angle of the motor output shaft 13 by this electromagnetic induction function, and to output this information signal to the control unit.

The motor output shaft 13 and the eccentric shaft portion 39 are rotatably supported by the small diameter ball bearing 37 and the needle bearing 38. The small diameter ball bearing 37 is provided on the outer circumference surface of the shaft portion 10*b* of the cam bolt 10. The needle bearing 38 is disposed on the outer circumference surface of the cylindrical portion 9*b* of the driven member 9, and disposed on the axial side portion of the small diameter ball bearing 37 (disposed adjacent to the small diameter ball bearing 37 in the axial direction).

The needle bearing 38 includes a cylindrical retainer 38*a* which is press-fit in the inner circumference surface of the eccentric shaft portion 39; and needle rollers 38*b* which are a plurality of rolling members that are rotatably held within the retainer 38*a*. These needle rollers 38*b* are rolled on the outer circumference surface of the cylindrical portion 9*b* of the driven member 9.

The small diameter ball bearing 37 includes an inner wheel which is sandwiched and fixed between the front end edge of the cylindrical portion 9*b* of the driven member 9 and the head portion 10*a* of the cam bolt 10; and an outer wheel which is fixed in the inner circumference surface of the eccentric shaft portion 39 which has the diameter-increased stepped shape by the press-fit, and which is abutted on the stepped edge formed on the inner circumference surface to be positioned in the axial direction.

A small diameter oil seal 46 is provided between the outer circumference surface of the motor output shaft 13 (the eccentric shaft portion 39) and the inner circumference surface of the extension portion 5*d* of the motor housing 5. The small diameter oil seal 46 is arranged to prevent the leakage of the lubricant from the inside of the speed reduction mechanism 12 to the inside of the electric motor 8. This oil seal 46 separates the electric motor 8 and the speed reduction mechanism 12 by the sealing function.

The control unit is arranged to sense a current driving state of the engine based on information signals from various sensors such as a crank angle sensor (not shown), an air flow meter (not shown), a water temperature sensor, and an accelerator opening degree sensor, and to perform the engine control based on these information signals. Moreover, the control unit is configured to perform rotation control of the motor output shaft 13 by energizing the coil 18 through the power feeding brushes 31*a* and 31*b*, the slip rings 26*a* and 26*b*, the switching brushes 25*a* and 25*b*, the commutator 21 and so on, and to control a relative rotational phase of the cam shaft 2 with respect to the timing sprocket 1 by the speed reduction mechanism 12.

As shown in FIG. 1 to FIG. 3, the speed reduction mechanism 12 includes the eccentric shaft portion 39 arranged to perform the eccentric rotation movement (to rotate in an eccentric state); a middle diameter ball bearing 47 which is provided on the outer circumference surface of the eccentric shaft portion 39; the rollers 48 which are provided on the outer circumference of the middle diameter ball bearing 47; the holding device 41 which is arranged to allow the movement of the rollers 48 in the radial direction while holding the rollers 48 in the rolling direction; and the driven member 9 which is integral with the holding device 41.

The eccentric shaft portion 39 includes a cam surface 39*a* formed on the outer circumference surface of the eccentric shaft portion 39. The cam surface 39*a* of the eccentric shaft portion 39 has a center axis Y which is slightly eccentric from a center axis X of the motor output shaft 13 in the radial direction.

The entire of the middle diameter ball bearing 47 is disposed to be substantially overlapped with the needle bearing 38 in the radial direction. The middle diameter ball bearing 47 includes an inner wheel 47*a*; an outer wheel 47*b*; and balls 47*c* disposed between the inner and outer wheels 47*a* and 47*b*. The inner wheel 47*a* is fixed on the outer circumference surface of the eccentric shaft portion 39 by the press-fit. The outer wheel 47*b* is not fixed in the axial direction so as to be a free state. That is, this outer wheel 47*b* includes a first end surface which is on the electric motor 8's side, and which is not abutted on any portions; and a second axial end surface which is disposed with a minute first clearance C1 between the second axial end surface and the inner side surface of the holding device 41 which confronts the second axial end surface. With this, the outer wheel 47*b* is in the free state. Moreover, the outer circumference surfaces of the rollers 48 are abutted on the outer circumference surface of the outer wheel 47*b* to be rolled on the outer circumference surface of the outer wheel 47*b*. An annular second clearance C2 is formed on the outer circumference side of the outer wheel 47*b*. The entire of the middle diameter ball bearing 47 is arranged to be moved in the radial direction by this second clearance C2 in accordance with the eccentric rotation of the eccentric shaft portion 39, that is, to perform the eccentric movement.

The rollers 48 are made from the iron series metal. The rollers 48 are arranged to be moved in the radial directions in accordance with the eccentric movement of the middle diameter ball bearing 47, and thereby to be inserted and mounted in the internal teeth 19*a* of the internal teeth constituting section 19. The rollers 48 are arranged to be pivoted in the radial direction while being guided in the circumferential direction by the both side edges of the roller holding holes 41*b* of the holding device 41.

A lubricant supply section is arranged to supply the lubricant to the inside of the speed reduction mechanism 12. This lubricant supply section includes an oil supply passage which is formed within the bearing 02 of the cylinder head 01, and to which the lubricant is supplied from a main oil gallery (not shown); an oil supply hole 56 which is formed in the cam shaft 2 in the axial direction, and which is connected to the oil supply passage through a groove 56*a* formed at a first end portion of the oil supply hole 56; an oil hole 57 which has a small diameter, which is formed inside the driven member 9 to penetrate in the axial direction, and which includes a first end opened to a groove 56*b* of a second end portion of the oil supply hole 56, and a second end opened to a portion near the needle bearing 38 and the middle diameter ball bearing 47; and an oil discharge hole (not shown) which is similarly formed in the driven member 9 to penetrate through the driven member 9.

This lubrication oil supply section is arranged to supply the lubrication oil into the receiving space 44, so that the lubrication oil is stored in the receiving space 44. The lubrication oil from the receiving space 44 lubricates the middle diameter ball bearing 47 and the rollers 48. Moreover, the lubrication oil flows into the inside of the motor output shaft 13, so as to lubricate the movable section such as the needle bearing 38 and the small diameter ball bearing 37.

Operations of this Embodiment

Hereinafter, operations of this embodiment are illustrated. Firstly, the timing sprocket 1 is rotated through the timing chain in accordance with the rotation of the crank shaft of the engine. This rotational force is transmitted through the internal teeth constituting section 19 and the internal screw constituting section 6 to the motor housing 5. With this, the motor housing 5 is synchronously rotated. On the other hand, the rotational force of the internal teeth constituting section 19 is transmitted from the rollers 48 through the holding device 41 and the driven member 9 to the cam shaft 2. With this, the cams of the cam shaft 2 open and close the intake valves.

Then, in a predetermined driving state of the engine after the start of the engine, the current is applied to the coil 18 of the electric motor 8 from the control unit through the power source feeding connector 33, the pigtail harnesses 42*a* and 42*b*, the power feeding brushes 31*a* and 31*b*, the slip rings 26*a* and 26*b*, and so on. With this, the motor output shaft 13 is rotated in the positive direction and in the negative direction. The speed of this rotational force is reduced by the speed reduction mechanism 12. This speed-reduced rotational force is transmitted to the cam shaft 2.

That is, when the eccentric shaft portion 39 is rotated to be eccentric in accordance with the rotation of the motor output shaft 13, each of the rollers 48 is got over one of the internal teeth 19*a* of the internal teeth constituting section 19 while being guided by the corresponding one of the roller holding holes 41*b* of the holding device 41 in the radial direction, at each one rotation of the motor output shaft 13. The each of the rollers 48 is rolled and moved to adjacent one of the internal teeth 19*a*. This movement of the each of the rollers 48 is repeated, so as to be rolled in the circumferential direction in the abutted state. The speed of the rotation of the motor output shaft 13 is reduced by this rolling movement of these rollers 48 in the abutted state. This speed-reduced rotational force is transmitted to the driven member 9. In this case, this speed reduction ratio can be arbitrarily set by a number of a difference between a number of the internal teeth 19*a* and a number of the rollers 48.

With this, the cam shaft 2 is relatively rotated in the positive direction or in the reverse direction relative to the timing sprocket 1, so as to convert the relative rotational phase. The opening or closing timing of the intake valve is controlled to be converted to the advance angle side or the retard angle side.

Each of the side surfaces of the stopper raised portion 61*b* is arranged to be abutted on one of the corresponding confronting surfaces 2*c* and 2*d* of the stopper recessed groove 2*b*, so as to restrict a maximum position of the positive and negative relative rotations of the cam shaft 2 with respect to the timing sprocket 1.

Accordingly, the opening or closing timing of the intake valve is converted to the maximum degree on the advance angle side or the retard angle side. Consequently, it is possible to improve the fuel economy (consumption) of the engine and the output of the engine.

Moreover, when the sensed portion 50 of the angle sensor 35 is rotated in accordance with the rotation of the motor output shaft 13 of the electric motor 8, the induced current between the sensed portion 50 and the sensing portion 51 flows. The integrated circuit 54 senses the rotation angle of the motor output shaft 13 by this electromagnetic induction function. The control unit senses the current rotation angle position of the motor output shaft 13 by this detection signal. The control unit outputs the rotation driving signal to the electric motor 8 by this rotation angle position and the rotation position of the crank shaft. With this, it is possible to accurately control the relative rotational phase of the cam shaft 2 with respect to the crank shaft in accordance with the current driving state of the engine.

In this embodiment, in a state where the phase varying mechanism 3 is mounted to the chain case (not shown) or the cylinder head, the power feeding brushes 31*a* and 31*b* are positioned at a position which is rotated substantially 90 degrees in the rotation direction of the motor housing 5 that is represented by a chain line in the drawing from a vertical line Q passing through the center axis P of the cover main body 28, as described above. That is, the power feeding brushes 31*a* and 31*b* are positioned on the horizontal line R on the front side (advance side) of the rotation direction of the motor housing 5 relative to the vertical line Q of the cover main body 28.

The slip rings 26*a* and 26*b* are slidably abutted on the tip end surfaces of the power feeding brushes 31*a* and 31*b* in accordance with the rotation of the motor output shaft 13, so that the metal abrasion powder (metal wearing powder) is generated. As shown by the hatching (the shaded area) of FIG. 7, this metal abrasion powder is discharged in the outward direction of the motor housing 5 while expanding from the positions of the power feeding brushes 31*a* and 31*b* in the outward direction along the rotation direction (the chain line) of the motor housing 5 to increase its diameter.

Accordingly, the metal abrasion powder I is discharged to the outside to avoid the angle sensor 35. Consequently, the metal abrasion powder I does not enter the sensed rotor 52 of the sensed portion 50 of the angle sensor 35, and the clearance C on the front side of the sensed rotor 52.

Therefore, it is possible to sufficiently suppress the deterioration of the detection accuracy of the rotation angle of the motor output shaft 13 by the angle sensor 35.

Moreover, the metal abrasion powder adhered to the slip rings 26*a* and 26*b* is shaken off at the stop and the start of the engine, and may be scattered from the upper portion side of the outer circumference surface of the support portion 50*a* of the sensed portion 50 into the sensed rotor 52's side.

However, in this embodiment, the tip end portion 50*b* of the support portion 50*a* of the sensed portion 50 is inserted and disposed in the recessed groove 36*a*. The position of the sensed rotor 52 is offset toward the outside (the cover portion 29's side) from the slidably abutting position between the slip rings 26*a* and 26*b* and the power feeding brushes 31*a* and 31*b*. Accordingly, the sensed rotor 52 is covered with the inner circumference surfaces of the recessed groove 36*a* and the large diameter groove 36*b*. Consequently, it is possible to sufficiently suppress the adhesion of the metal abrasion powder to the sensed rotor 52.

In particular, in this embodiment, the recessed groove 36*a* and the large diameter groove 36*b* are (constitutes) the labyrinth grooves. Accordingly, it is possible to prevent the shaken-off metal abrasion powder from flowing toward the tip end portion 50*b* of the support portion 50*a* by this labyrinth effect, and to sufficiently suppress the flow of the metal abrasion powder toward the sensed rotor 52.

Consequently, it is possible to suppress the deterioration of the accuracy of the rotation detection of the angle sensor 35 due to the influence of the metal abrasion powder, by the above-described structure and the position of the power feeding brushes 31*a* and 31*b*, and to improve the durability.

Moreover, in this embodiment, the cover member 4 has a thin axial width. Accordingly, it is possible to sufficiently decrease the axial length of the entire valve timing control apparatus. Consequently, it is possible to improve the size of the valve timing control apparatus, and thereby to improve the mountability of the valve timing control apparatus to the engine room.

Furthermore, the tip end portion 50*b* of the support portion 50*a* of the sensed portion 50 is received and held within the recessed groove 36 in a state where the tip end portion 50*b* is inserted and mounted in the recessed groove 36 from the axial direction, as described above. Accordingly, it is also possible to decrease the axial length of the entire valve timing control apparatus.

Second Embodiment

Figure 10:
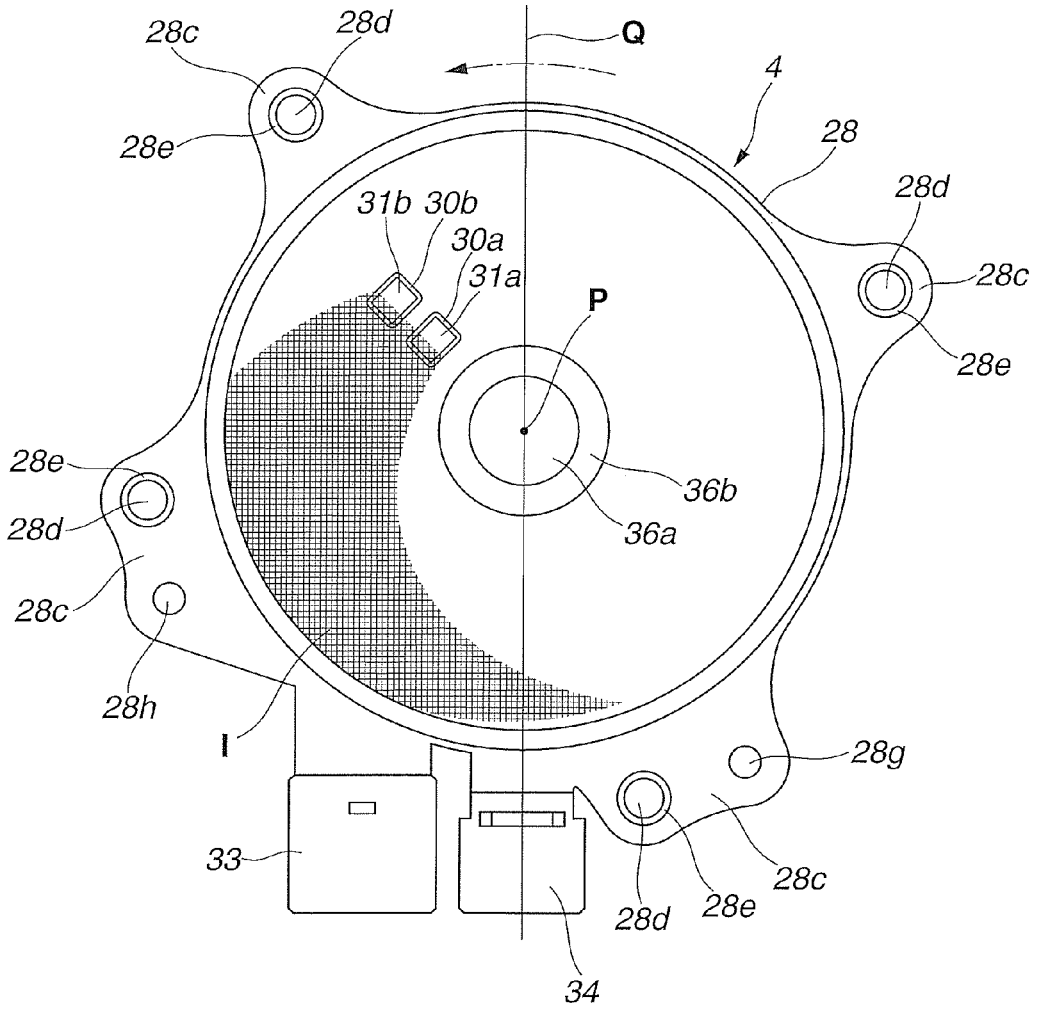
FIG. 10 is a front view showing a cover main body in a valve timing control apparatus according to a second embodiment of the present invention.

FIG. 10 shows a valve timing control apparatus according to a second embodiment of the present invention. In this valve timing control apparatus according to the second embodiment, in a state where the phase varying mechanism 3 is mounted to the chain case (not shown) or the cylinder head, the power feeding brushes 31*a* and 31*b* (the brush holders 30*a* and 30*b*) are provided at positions of the cover main body 28 which is rotated about 45 degrees in the rotation direction of the motor housing 5 from the uppermost position of the vertical line Q passing through the center axis P of the cover member 28.

Accordingly, as shown by the hatching (shaded area) of FIG. 10, the metal abrasion powder I is discharged in the outside direction of the motor housing 5 to expand from the positions of the power feeding brushes 31*a* and 31*b* in the outside direction corresponding to the leftward direction of FIG. 10 along the rotation direction (a chain line direction) of the motor housing 5 to increase its diameter.

Consequently, the metal abrasion powder I is discharged to the outside to avoid the angle sensor 35. The metal abrasion powder I does not enter the sensed rotor 52 of the sensed portion 50 of the angle sensor 35, and the clearance C on the front side of the sensed rotor 52.

Therefore, it is possible to sufficiently suppress the deterioration of the accuracy of the detection of the rotation angle of the motor output shaft 13 by the angle sensor 35.

The other structures according to the second embodiment are identical to those of the first embodiment. Accordingly, it is possible to obtain the same operations and the same effects.

Third Embodiment

Figure 11:
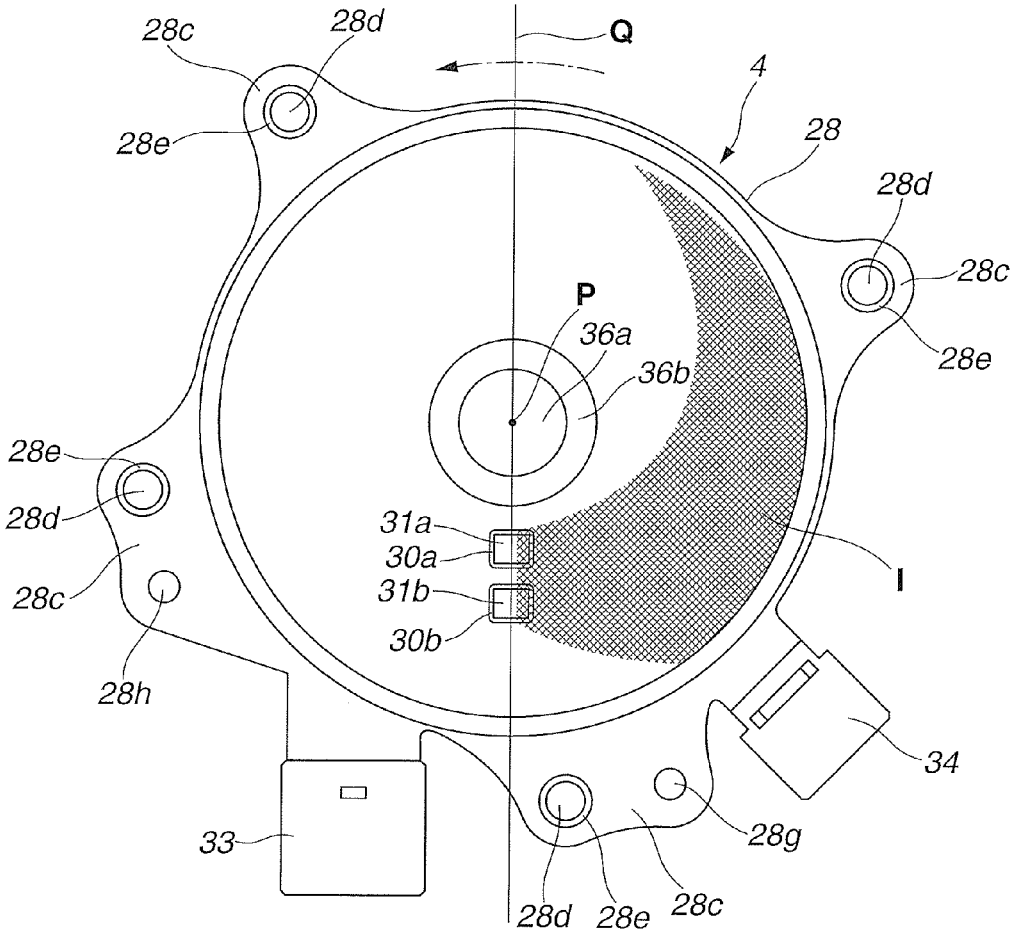
FIG. 11 is a front view showing a cover main body in a valve timing control apparatus according to a third embodiment of the present invention.

FIG. 11 shows a valve timing control apparatus according to a third embodiment of the present invention. In this valve timing control apparatus according to the third embodiment, in a state where the phase varying mechanism 3 is mounted to the chain case (not shown) or the cylinder head, the power feeding brushes 31*a* and 31*b* (the brush holders 30*a* and 30*b*) are provided at a lowermost position on the vertical line direction Q.

Accordingly, as shown by a hatching (shaded area) in FIG. 11, the metal abrasion powder I is discharged in the outside direction of the motor housing 5 to expand from the positions of the power feeding brushes 31*a* and 31*b* in the outside direction corresponding to a rightward direction of FIG. 11 along the rotation direction (a chain line direction) of the motor housing 5 in a diameter increasing manner to increase its diameter.

Consequently, the metal abrasion powder I is discharged to the outside to avoid the angle sensor 35, similarly to the first and second embodiments. Therefore, the metal abrasion powder I does not enter the sensed rotor 52 of the sensed portion 50 of the angle sensor 35, and the clearance C on the front side of the sensed rotor 52.

Accordingly, it is possible to sufficiently suppress the deterioration of the accuracy of the rotation detection of the motor output shaft 13 by the angle sensor 35.

Besides, in this embodiment, the power source supply connector 33 and the signal connector 34 are not parallel with each other. The power source supply connector 33 and the signal connector 34 are disposed on both sides of the large boss portion 28*c* to sandwich the large boss portion 28*c*. With this, it is possible to decrease the wiring arrangement of the terminal strip of the power supply connector 33.

The present invention is not limited to the structures according to the embodiments. The power feeding brushes 31*a* and 31*b* can be formed at any portions from a position which is rotated a predetermined angle from the uppermost position of the vertical line Q in the rotation direction of the motor housing, to a lowermost position shown in the third embodiment, in a state where the phase varying mechanism 3 is mounted to the chain case (not shown) or the cylinder head, as long as the metal abrasion powder I is scattered toward the angle sensor 35.

Moreover, it is possible to arbitrarily vary the depth and the sectional shape of the large diameter grove 36*b*.

Moreover, the driving rotation member includes the timing pulley, in addition to the timing sprocket.

The entire contents of Japanese Patent Application No. 2014-188352 filed Sep. 17, 2014 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control apparatus for an internal combustion engine comprising:

a first member to which a rotational force is transmitted from a crank shaft;

a second member which is arranged to be rotated relative to the first member, and to rotate as a unit with a cam shaft;

an electric motor which includes a motor housing that is provided to the first member to rotate as a unit with the first member, and a motor output shaft, and which is arranged to rotate the second member relative to the first member by the motor output shaft;

a cover member which is disposed on an outer end surface of the electric motor to confront the outer end surface of the electric motor in an axial direction;

a slip ring which has an annular shape, which is provided to one of the electric motor and the cover member, and which is provided coaxially with the motor output shaft;

a power feeding brush which is provided to the other of the electric motor and the cover member, and which includes a tip end portion arranged to be slidably abutted on the slip ring; and a rotation angle sensing mechanism which is provided between one end portion of the motor output shaft, and the cover member confronting the one end portion of the motor output shaft, and which is arranged to sense a rotation angle of the motor output shaft, the power feeding brush being disposed in a range in which the power feeding brush is slid on the slip ring, in a range from a position which is deviated a predetermined angle in a rotation direction of the motor housing from an uppermost position of the other of the electric motor and the cover member in a vertical direction, to a lowermost position.

2. The valve timing control apparatus as claimed in claim 1, wherein the rotation angle sensing mechanism includes a sensing portion and a sensed portion; the sensed portion is provided at the one end portion of the motor output shaft; and the sensing portion is provided to the cover member.

3. The valve timing control apparatus as claimed in claim 1, wherein the power feeding brush is provided at a position in a direction substantially perpendicular to the vertical direction.

4. The valve timing control apparatus as claimed in claim 1, wherein the power feeding brush is provided at a position of a side portion on a horizontal line of the rotation angle sensing mechanism.

5. The valve timing control apparatus as claimed in claim 1, wherein the power feeding brush is provided at a position which is rotated substantially 45 degrees from the uppermost position in the vertical direction in the rotation direction of the motor housing.

6. The valve timing control apparatus as claimed in claim 1, wherein the power feeding brush is provided on a lower side of the rotation angle sensing mechanism in the vertical direction.

7. A valve timing control apparatus for an internal combustion engine comprising:

a driving rotation member which is arranged to be rotated by a rotational force from a crank shaft;

a driven rotation member which is arranged to be rotated relative to the driving rotation member, and to rotate synchronously with a cam shaft;

an electric motor which includes a motor housing that is provided to the driving rotation member to rotate as a unit with the driving rotation member, and a motor output shaft, and which is arranged to rotate the driven rotation member relative to the driving rotation member;

a cover member disposed to confront and cover a front end portion of the electric motor;

a slip ring which is provided to the electric motor, which has an annular shape, and which is disposed coaxially with the motor output shaft;

a power feeding brush which is provided to the cover member, and which includes a tip end portion slidably abutted on the slip ring; and a rotation angle sensing mechanism which is provided between one end portion of the motor output shaft, and the cover member confronting the one end portion of the motor output shaft, and which is arranged to sense a rotation angle of the motor output shaft, the power feeding brush being provided in a range from a predetermined angle position in the rotation direction of the motor housing from an uppermost position of the cover member in a vertical direction, to a lowermost position in the rotation direction of the motor housing.

8. The valve timing control apparatus as claimed in claim 7, wherein the slip ring is a first slip ring which is an annular conductive member; the valve timing control apparatus further comprises a second slip ring which is provided to the electric motor which is disposed coaxially with the motor output shaft, and which is an annular conductive member; the first slip ring and the second slip ring which are disposed, respectively, at a radially inside portion and a radially outside portion; the power feeding brush is a first power feeding brush which includes the tip end portion slidably abutted on the first slip ring, and which is a conductive member; and the valve timing control apparatus further comprises a second power feeding brush which is provided to the cover member, which includes a tip end portion slidably abutted on the second slip ring, and which is a conductive member.

9. The valve timing control apparatus as claimed in claim 8, wherein the rotation angle sensing mechanism is constituted by an electromagnetic induction angle sensor.

* * * * *